US006267118B1

(12) United States Patent
Ito et al.

(10) Patent No.: US 6,267,118 B1
(45) Date of Patent: Jul. 31, 2001

(54) WIG FIXING MEMBER AND METHOD OF USING THE SAME

(75) Inventors: Masataka Ito; Masahiro Makino; Masatoshi Seki, all of Niigata-ken (JP)

(73) Assignee: Aderans Co., Ltd., Tokyo (JP)

( * ) Notice: Subject to any disclaimer, the term of this patent is extended or adjusted under 35 U.S.C. 154(b) by 0 days.

(21) Appl. No.: 09/424,469

(22) PCT Filed: Sep. 29, 1998

(86) PCT No.: PCT/JP98/04365

§ 371 Date: Nov. 23, 1999

§ 102(e) Date: Nov. 23, 1999

(87) PCT Pub. No.: WO99/48394

PCT Pub. Date: Sep. 30, 1999

(30) Foreign Application Priority Data

Mar. 23, 1998 (JP) ..... 10-92214

(51) Int. Cl.[7] ..... A41G 3/00
(52) U.S. Cl. ..... 132/201; 132/53
(58) Field of Search ..... 132/201, 53, 54, 132/56, 270

(56) References Cited

U.S. PATENT DOCUMENTS 851,384 * 4/1907 Sleicher ..... 132/53
2,850,023 * 9/1958 Taylor ..... 132/53
3,662,766 * 5/1972 Maassen et al. ..... 132/201
5,033,486 * 7/1991 Finamore et al. ..... 132/201
6,170,491 * 1/2001 Maekawa ..... 132/201

* cited by examiner

*Primary Examiner*—Todd E. Manahan
(74) *Attorney, Agent, or Firm*—Wenderoth, Lind & Ponack, L.L.P.

(57) ABSTRACT

A wig fitting implement which performs the fitting of a wig to a head surely and stably, can be put on and taken off easily, has no bad influence on the head like eczema and a rash, and has excellent workability is provided. A method of use of the wig fitting implement is also provided. The wig fitting implement 1 comprises a net-like base 2 divided into four regions. These regions correspond to a left side front surface (B side), a left side rear surface (D side), a right side front surface (A side) and a right side rear surface (C side). Double-sided tapes 3 (A1, B1, C1 and D1) and protective tapes 4 (A2, B2, C2 and D2) are adhered to each region. B1 of the B side is adhered to a surrounding rim part 13 of a flexible planar component 9 of a wig 7, and a natural hair 12 of a head skin 10 passes through penetration holes 6 and is held between C1 and B1 to fix the natural hair. The fitting of the natural hair 12 is performed surely by inserting the natural hair 12 up to the root thereof through the penetration holes 6 of the wig fitting implement 1.

5 Claims, 6 Drawing Sheets

WIG FIXING MEMBER AND METHOD OF USING THE SAME

TECHNICAL FIELD

The present invention relates to an artificial hair fitting implement for fitting a wig with artificial hair planted thereon, or false hair of artificial hair bundled thereon, to a head, and a method of use thereof.

TECHNICAL BACKGROUND

There have existed a lot of artificial hair fitting implements for fitting a wig with artificial hair planted thereon, or false hair of artificial hair bundled thereon, to a head, and methods of use thereof.

For example, as methods for fitting a wig, with artificial hair planted thereon, to the head can be mentioned a method of fitting a wig by fastening the natural hair to a stopper with a lot of teeth of a comb provided on the back of the wig, and a method of fitting a wig by applying an adhesive onto the wig or the head.

In addition, recently there has been employed a method of fitting a wig to the head by providing a slit or a protrusion on the wig, pulling the natural hair therethrough, and applying an adhesive onto an outlet of the slit or the protrusion.

Of these conventional methods of fitting a wig, those employing a stopper are excellent in that the wig can be put on and taken off easily, but since the stopper itself has some thickness, the feeling of the wig during wearing thereof is unnatural. Also, since the stopper is made of a resin or a metal and always directly touches the head skin, it is improper to wear the wig for a long time. Moreover, in the case of sleeping with a worn wig, stimulation to the head skin becomes strong and results in unbearable pain at times. Moreover, since the wig is fitted by fastening the natural hair to the teeth of a comb, the wig slips in the case of severe exercise or long-term wearing, and thereby the hair fastened to the stopper is pulled, which results in an unpleasantness being experienced by the wearer.

In the case of a method of employing an adhesive, when a wig is fitted by an adhesive, the wig scarcely slips during severe exercise. Also, even in the case of sleeping with the worn wig, no feeling of oppression is experienced by the head skin and the feeling of the wearing of the wig is advantageously natural.

However, while applying the wig, the wig easily slips, and thus, a lot of skill and a lot of time are required to apply the wig. In addition, since an adhesive is employed, a rash and eczema are liable to occur on the head skin. Also, when the wig is removed, it takes much time to remove the adhesive.

The present invention solves these problems and intends to provide a safe and sanitary artificial hair fitting implement which facilitates the wearing and fitting of a wig or false hair without slippage of the wig while applying it, has a sufficient fitting strength thereof to the head, and causes neither adhesion nor remainder of an adhesive on the head such that a rash and eczema is not realized. A method of use of the hair fitting implement is also provided.

DISCLOSURE OF THE INVENTION

The present invention is, with a view to accomplishing the above object, an artificial hair fitting implement to be used for fitting a wig with artificial hair planted thereon, or false hair of artificial hair bundled thereon, to a head. The artificial hair fitting implement is characterized in that a net-like base is divided by providing a bending part at a roughly central part thereof. Double-sided tapes with a releasing paper are adhered to front and back surfaces of one side and the back surface of the other side. A double-sided tape with a fine-net-like component, instead of a releasing paper, is adhered to the front surface of the other side, which is the side coming into contact with the head skin. And, penetration holes for pulling the natural hair therethrough are provided in the other side.

Moreover, the present invention is characterized in that the penetration holes are formed of roughly cross-shaped holes, a group of horizontal slits, a group of vertical slits, a group of horizontal slots, a group of vertical slots, and mixtures thereof.

In addition, the present invention is characterized in that, in fitting a wig with artificial hair planted thereon to the head by using the above-mentioned artificial hair fitting implement, the releasing paper on the front surface of the one side is removed and fitted to a surrounding rim part of a back of the wig. Then the natural hair is pulled through the penetration holes from the back surface to the front surface of the other side. At the same time a releasing paper on the back surface of the one side is removed. Then the double-sided tapes on the back surfaces are adhered to each other to fix the natural hair, and thereby the wig is fitted to the head.

DESCRIPTION OF THE PREFERRED EMBODIMENT

Hereunder, an artificial hair fitting implement according to the present invention and a method of the use thereof will be described in reference to the drawings.

Figure 8:
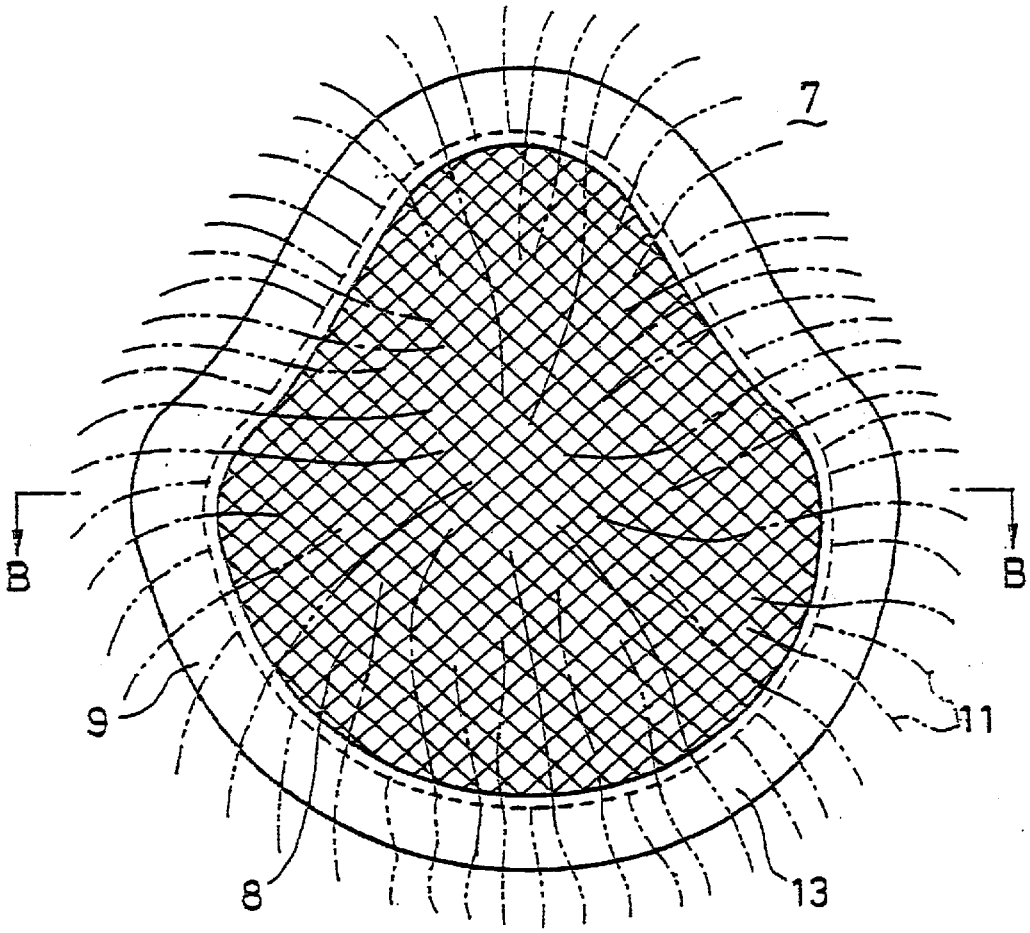
FIG. 8 is a plan view showing the general structure of a wig with artificial hair planted thereon to be used together with an artificial hair fitting implement according to the present invention.
Figure 9:
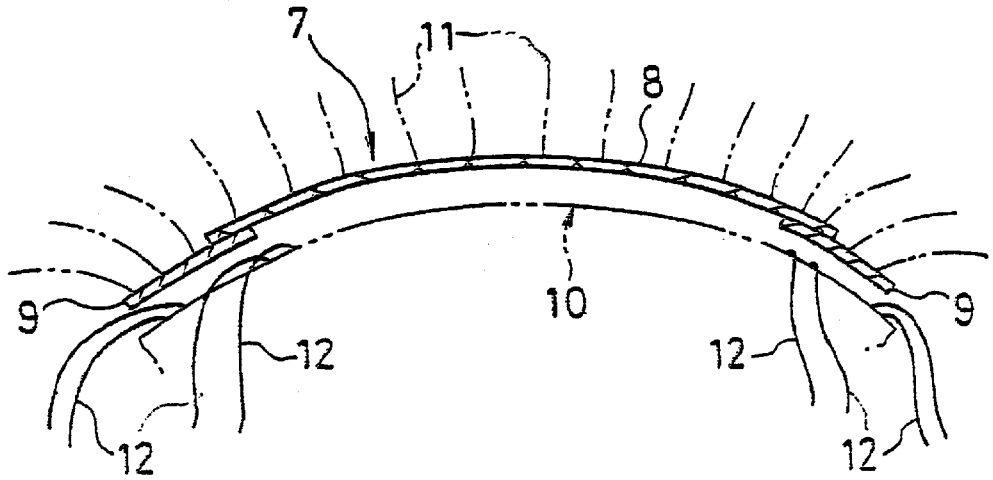
FIG. 9 is an enlarged cross-sectional view of the wig along line B—B of FIG. 8.

First of all, one example of a wig to be fitted to a head by virtue of an artificial hair fitting implement according to the present invention will be described according to FIG. 8 and FIG. 9.

A wig 7 consists of a net-like component 8 and a flexible belt-like component 9. The flexible belt-like component 9 is formed of a narrow belt-like component having an outer profile proper for the form of the head skin 10 at the position of wearing the wig, and outer profile parts of the net-like component 8 are stuck in piles to an inner profile almost similar to the outer profile. A lot of aritficial hairs 11, 11 . . . are planted on the net-like component 8 and the flexible belt-like component 9.

In the drawings, the artificial hair 11 is indicated by a dotted line and the natural hair 12 is indicated by a solid line in order to discriminate the artificial hair 11 from the natural hair 12.

A plurality of artificial hair fitting implements 1 to be described hereunder are stuck to a surrounding rim part 13 of the flexible belt-like component 9 at a proper interval in actual use.

Figure 1:
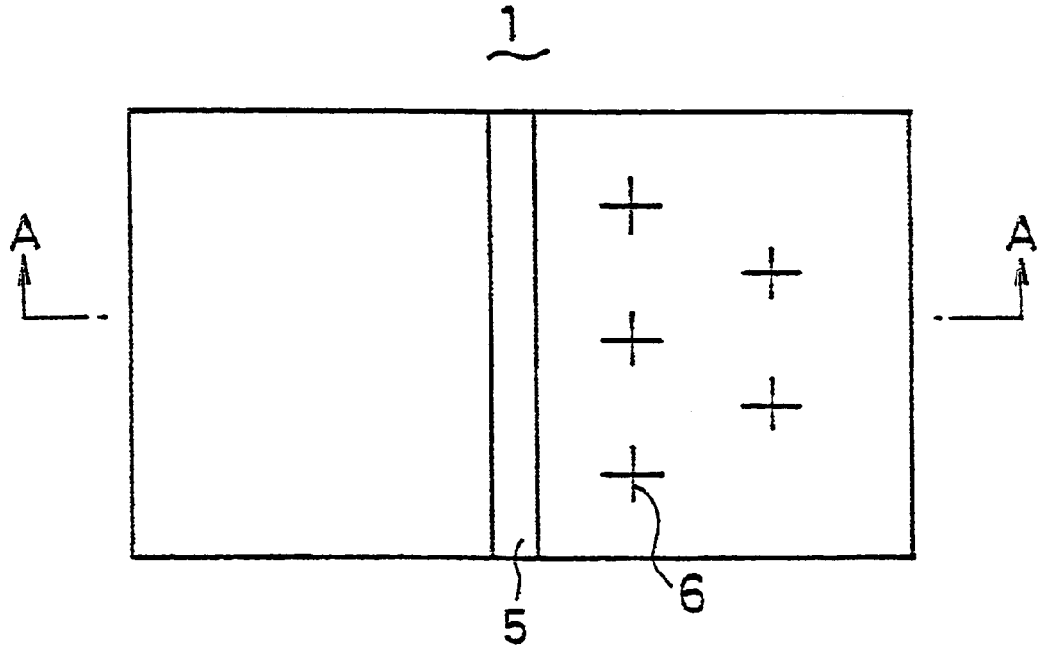
FIG. 1 is a plan view of an artificial hair fitting implement according to the present invention.

The artificial hair fitting implement 1 has a square form as shown in FIG. 1 and consists of an ultra-thin component of several hundreds microns.

Figure 2:
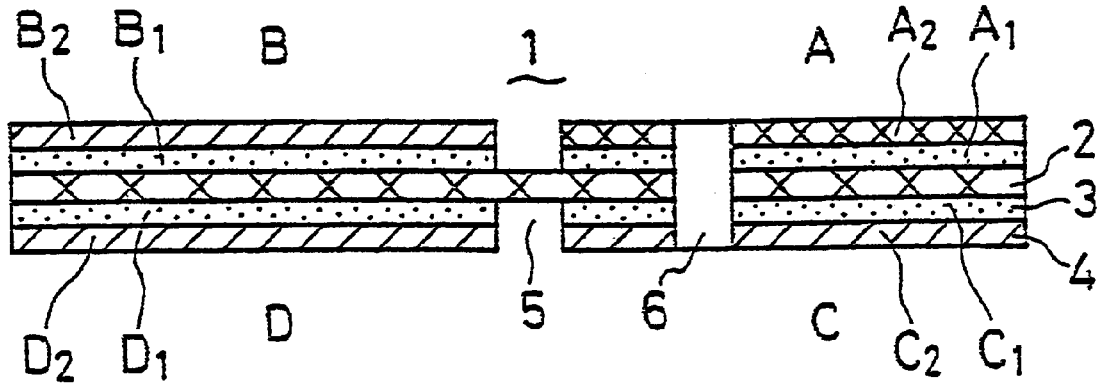
FIG. 2 is a schematic cross-sectional view of the artificial hair fitting implement along line A—A of FIG. 1.

For description, the artificial hair fitting implements 1 are divided into four regions with the area of each region being almost equal to the area of each other region. As shown in FIG. 2, the region on a front surface of the left side is designated the B side, the region on a back surface of the left side is designated the D side, the region on a front surface of the right side is designated the A side, and the region on a back surface of the right side is designated the C side. FIG. 2 shows the A—A line cross-sectional view of FIG. 1, which is schematically enlarged for clear understanding of each constitutional part.

The artificial hair fitting implement 1 consists of a net-like base 2, double-sided tapes 3 to be stuck to each of the A side, the B side, the C side and the D side, and protective tapes 4 to be stuck to the surfaces of the double-sided tapes 3.

For description, the double-sided tapes 3 on the A side, the B side, the C side and the D side are designated A1, B1, C1 and D1, respectively, and the protective tapes 4 on the A side, the B side, the C side and the D side are designated A2, B2, C2 and D2, respectively.

Of these protective tapes, B2, C2 and D2 are formed of a releasing paper, and the protective tape A2 of the A side is formed of a fine-net-like component.

In FIG. 2, the B side is stuck to the surrounding rim part 13 of the wig 7, the A side is at the position of the head skin 10, and the C side and the D side are adhered to each other.

The artificial hair fitting implements 1 with the above structure are bent and formed freely, with a border that separates the B side and the D side from the A side and the C side being indicated as a bending part 5.

As shown in FIG. 1 and FIG. 2, on the A side and the C side are provided a proper number of roughly cross-shaped penetration holes 6, for example, as shown in FIG. 1.

The penetration holes 6 have such a size that the natural hair 12 can pass therethrough.

The roughly cross-shaped penetration holes 6 shown in FIG. 1 preferably have such a form and size that the holes will be able to hold the natural hair 12.

The penetration holes 6 are not restricted to the cross shape shown in FIG. 1 so long as the natural hair 12 can pass through the holes and be held therein.

Forms contemplated are shown in FIG. 3 to FIG. 7.

Figure 3:
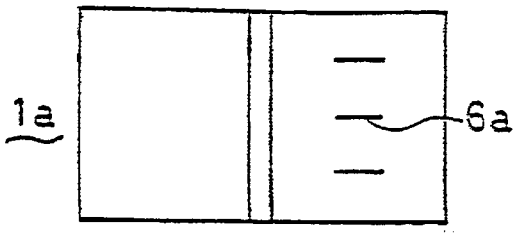
FIG. 3 is a plan view showing an artificial hair fitting implement with penetration holes provided in a horizontally linear state.
Figure 4:
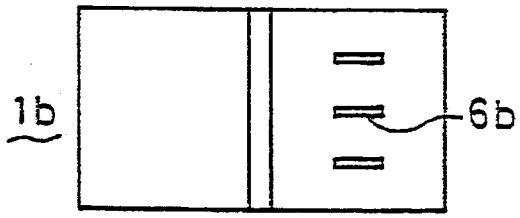
FIG. 4 is a plan view showing an artificial hair fitting implement with penetration holes provided in a horizontal-slit-like state.

The artificial hair fitting implement 1*a* of FIG. 3 has horizontally linear penetration holes or slits 6*a,* and the artificial hair fitting implement 1*b* of FIG. 4 has horizontally-extended slot-like penetration holes 6*b*.

Figure 5:
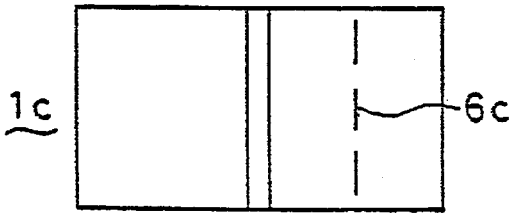
FIG. 5 is a plan view showing an artificial hair fitting implement with penetration holes provided in a vertically linear state.
Figure 6:
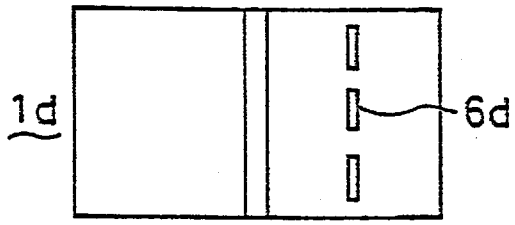
FIG. 6 is a plan view showing an artificial hair fitting implement with penetration holes provided in a vertical-slit-like state.

The artificial hair fitting implement 1*c* of FIG. 5 has vertically linear penetration holes or slits 6*c,* and the artificial hair fitting implement 1*d* of FIG. 6 has vertically-extended slot-like penetration holes 6*d*.

Figure 7:
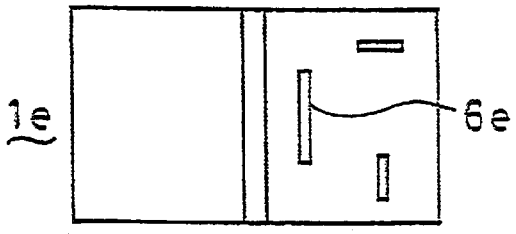
FIG. 7 is a plan view showing an artificial hair fitting implement with penetration holes provided both in a vertical-slit-like state and a horizontal-slit-like state.

Moreover, the penetration holes 6*e* of the artificial hair fitting implement 1*e* of FIG. 7 are slot-like penetration holes combined properly.

The penetration holes provided are only required to have such a size that the natural hair 12 can pass therethrough and be held therein, and hence, they do not always need to be linear and may be flexed or curved.

Next, a method of fitting the wig 7 to the head skin 10 by virtue of the artificial hair fitting implement 1 shown in FIG. 1 and FIG. 2 will be described according to FIG. 10 to FIG. 16.

Figure 10:
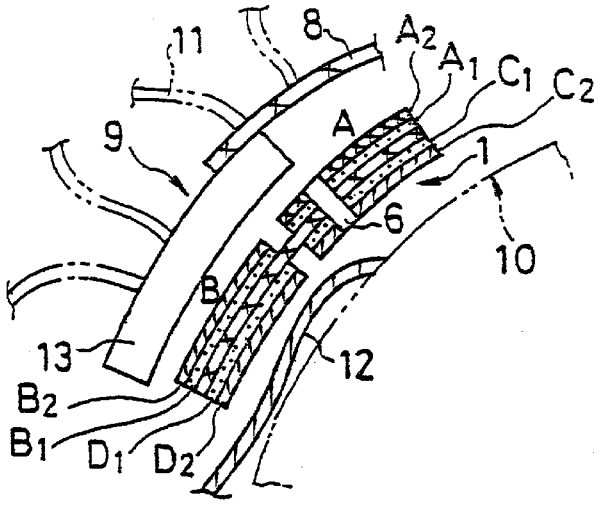
FIGS. 10–15 are enlarged schematic views for describing a method of using an artificial hair fitting implement according to the present invention for fitting a wig to a head by virtue of the artificial hair fitting implement.

FIG. 10 shows the position of the wig 7 relative to the head skin 10 and the arrangement of the artificial hair fitting implement 1 to be fixed therebetween.

That is, the wig 7 is set at a prescribed position relative to the head skin 10. The artificial hair fitting implement 1 is stuck to the surrounding rim part 13 of the inner surface of the head skin 10 side of the wig 7. In this case, as shown in the drawing, the B side and the A side of the artificial hair fitting implement 1 are facing the surrounding rim part 13, and the C side and the D side are facing the head skin 10.

Figure 11:
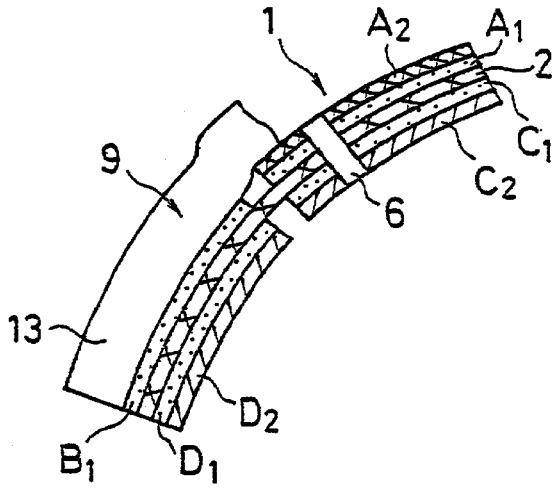

In a state shown in FIG. 10, B2 as the protective tape of the B side is taken off and the double-sided tape B1 is stuck to the surrounding rim part 13 of the wig 7 as shown in FIG. 11. The protective tapes of the sides other than the B side, namely, A2, C2 and D2, remain in place.

The above is a first procedure of the method of fitting the wig 7 to the head skin 10.

Figure 12:
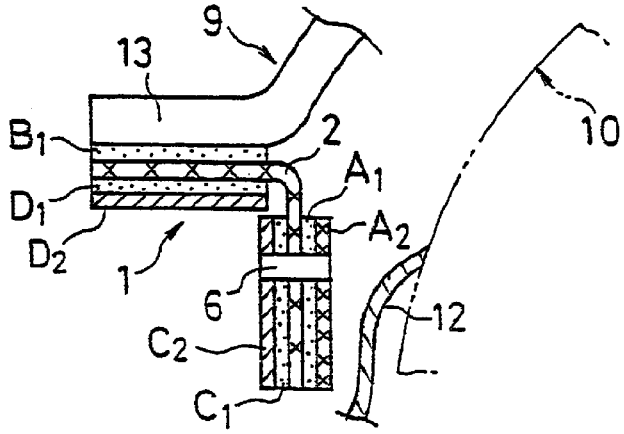

Next, as shown in FIG. 12, when the surrounding rim part 13 of the wig 7 is rolled up, the artificial hair fitting implement 1 is bent naturally at the bending part 5, and the A side and the C side are positioned at the head skin 10.

The above is a second procedure of the method of fitting the wig 7 to the head skin 10.

Figure 13:
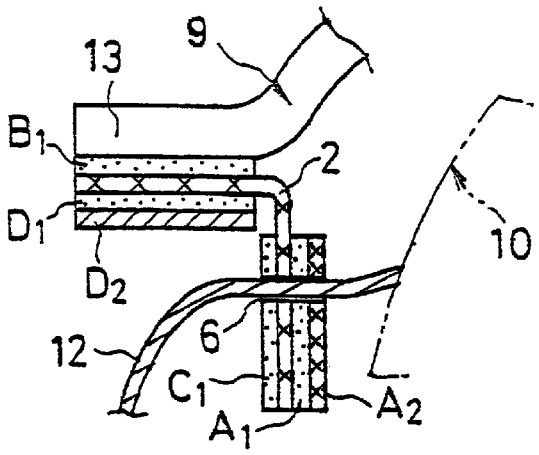

Next, as shown in FIG. 13, C2 as the protective tape of the C side is taken off and at the same time the natural hair 12 of the head skin 10 is pulled from the A side to the C side through the penetration holes 6.

This is a third procedure of the method of fitting the wig 7 to the head skin 10.

The drawing of the natural hair from the penetration holes 6 can be performed easily by employing a hooked drawing implement.

Figure 14:
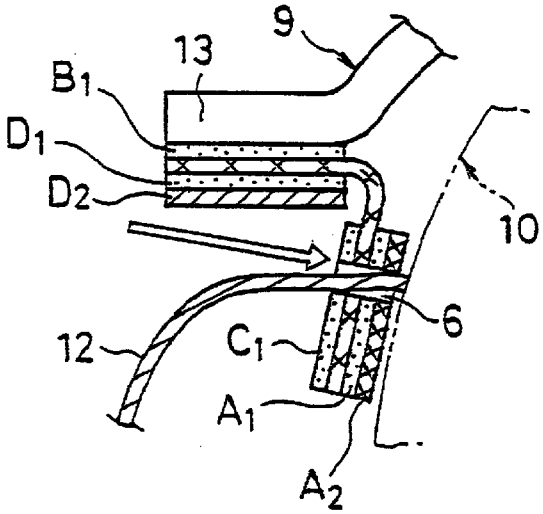

Next, as shown in FIG. 14, the C side is pressed to allow A2 of the A side to nearly come into contact with the head skin 10, and at the same time the natural hair 12 is pulled lightly so that the A side should surely be positioned near the root of the natural hair 12.

In this case, if the penetration holes 6 are pressed from the C side by a sharp thin rod, the drawing of the natural hair 12 can be performed more surely.

This is a fourth procedure of the method of fitting the wig 7 to the head skin 10.

In this case, if the volume of natural hair 12 remaining on the head is small and a lot of natural hair 12 is hard to pull out, the fitting of the artificial hair fitting implement 1 to the head skin 10 can be performed more surely by applying a very small amount of an adhesive around the penetration holes 6 of the C side to the natural hair 12 pulled out.

Figure 15:
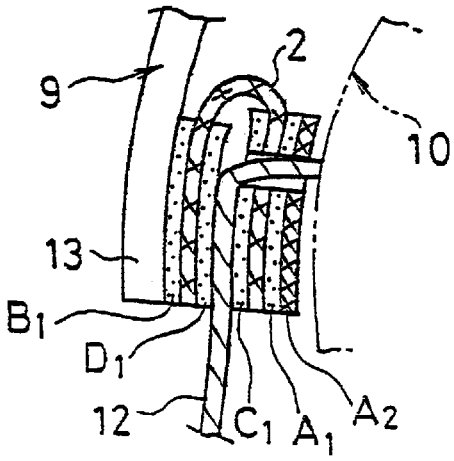

Next, D2 as the protective tape of the D side is taken off, and C1 and D1 are adhered to each other in a state that the natural hair 12 is held between C1 and D1 as shown in FIG. 15.

Thereby, the artificial hair fitting implement 1 is fitted to the head skin 10 via the natural hair 12.

This corresponds to a fifth procedure of the method of fitting the wig 7 to the head skin 10.

According to the above, the wig 7 is fitted to the head integrally.

Figure 16:
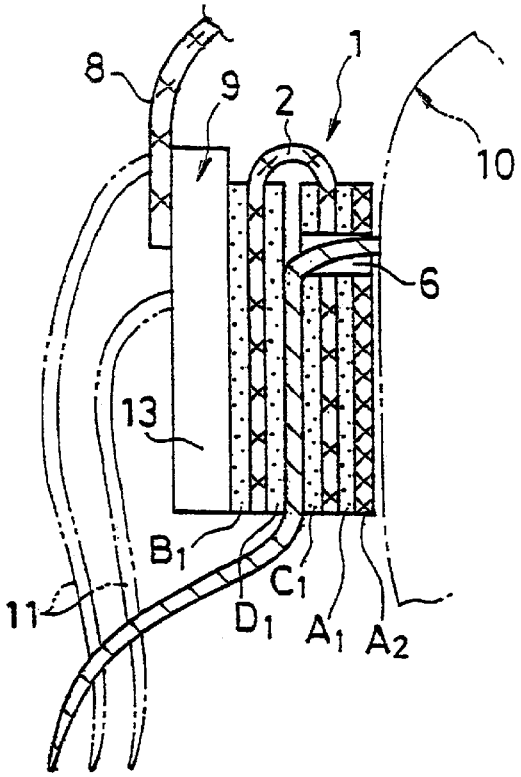
FIG. 16 is a partially enlarged schematic view showing the fitting state of the head skin and a wig according to the present invention.

FIG. 16 is a schematic enlarged view of this state.

As shown in FIG. 16, A2 as the protective tape only comes into contact with the head skin 10 at the A side. Since A2 is a close-meshed net-like component, the head skin 10 does not come into direct contact with A1, which is the double-sided tape 3, and thus, adhesive of the double-sided tape 3 neither adheres to the head skin 10 nor remains on the head skin 10 when the wig is removed.

Accordingly, there is no fear of eczema or a rash caused by the adhesive.

Moreover, the wig 7 and the artificial hair fitting implement 1 are surely fitted by B1, and the natural hair 12 is fixed and held by D1 and C1, and thus, the fixed wig does not slip.

As described above, it is easy to wear a wig by employing an artificial hair fitting implement according to the present invention, and it can be performed surely.

FIG. 16 and the like show one natural hair 12 passing through a penetration hole 6, but a lot of natural hairs are allowed to actually pass through each penetration hole.

Next, the removal of the wig 7 will be described.

First of all, the surrounding rim part 13 of the wig 7 in a state as shown in FIG. 16 is rolled up and removed from B1, and thereby the wig 7 is removed from the head skin 10.

Next, the B side and the D side of the artificial hair fitting implement 1 are pulled outwardly such that D1 is removed from C1, and thereby the fixing of the natural hair 12 is released.

In this state, the artificial hair fitting implement 1 is separated slowly from the head and removed from the head skin 10.

If the natural hair 12 and the C side are impregnated with a light-removing liquid before separating this artificial hair fitting implement 1 from the head skin 10, and then the removing of the artificial hair fitting implement 1 is performed, there is no fear of the adhesion of an adhesive component to the natural hair 12 such that the natural hair sticks to the C side and falls off. Also, no unpleasantness is realized by the natural hair being pulled during the removal of the hair fitting implement 1, and the removal can be performed easily and in a shorter time. The impregnating of the natural hair 12 and the C side can be performed by lightly tapping the natural hair and the C side with cotton that is impregnated with a light-removing liquid.

As described above, the penetration holes 6 of the artificial hair fitting implement 1 of the present invention may have various forms.

Moreover, if the number and the form of the penetration holes 6 are properly changed according to the thickness and the volume of the natural hair, due to sex and age, the wig will be easier to use, and it will be possible to fit the wig more stably.

Figure 17:
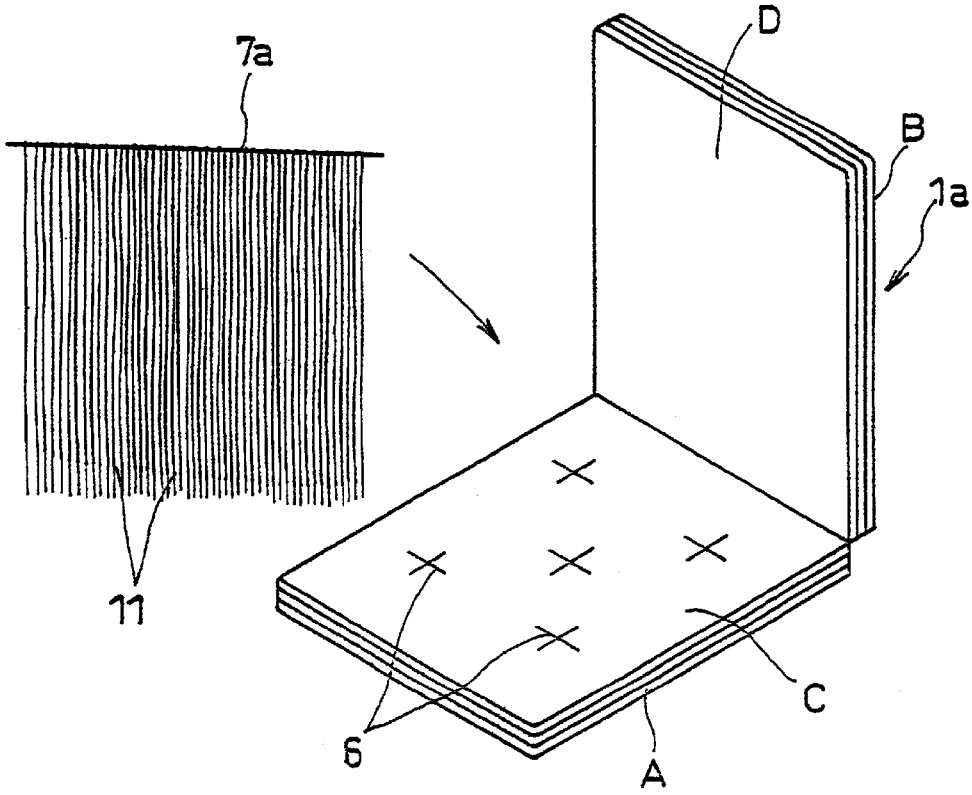
FIG. 17 is a whole perspective view showing the case of employing an artificial hair fitting implement according to the present invention for false hair.

In the above, the fitting of the wig for covering the whole head skin has been described; however, the artificial hair fitting implement 1 of the present invention can also be employed as a false hair fitting component in the case of covering only a spot with partially thin hair and as a fashionable accessory, as shown in FIG. 17.

That is, the natural hair 12 is passed through the penetration holes 6 of the A side, which comes into contact with the head skin, and the natural hair is then pulled toward the C side. Then the protective tape C2 is removed and the natural hair is adhered thereto. At this time, if the C side is pressed toward the head skin 10 while pulling the natural hair 12 lightly, the artificial hair fitting implement 1*a* is fitted to the head skin 10 surely, and thereby looseness and slippage are prevented from occurring.

After the natural hair 12 pulled through the penetration holes 6 is adhered and surely fitted onto the C side of the artificial hair fitting implement 1*a*, a lot of artificial hairs 11 are bundled at one side, and the bundled false hair 7*a* is placed on the C side. Then D2 as the protective tape of the D side is removed and the artificial hair fitting implement 1 is bent at the bending part 5, D1 and C1 are adhered to each other, and the artificial hair fitting implement 1*a* and the bundled false hair 7*a* are fitted.

In this state, the natural hair of an upper side is dropped down on the B side, and the natural hair is fixed so that it should cover the whole artificial hair fitting implement 1*a* when combed or brushed. Thus, the fitting of the false hair 7*a* is finished.

For the fitting of the false hair 7*a*, it is also possible to fit the false hair 7*a* to the B side of the artificial hair fitting implement 1*a*.

That is, the natural hair 12 is passed through the penetration holes 6 of the A side, which comes into contact with the head skin, and the natural hair is then pulled toward the C side. Then the protective tape C2 is removed and the natural hair is adhered thereto. At this time, if the C side is pressed toward the head skin 10 while pulling the natural hair 12 lightly, the artificial hair fitting implement 1*a* is fitted to the head skin 10 surely, and thereby looseness and slippage are prevented from occurring.

After the natural hair 12 pulled through the penetration holes 6 is adhered and surely fitted onto the C side of the artificial hair fitting implement 1*a*, the protective tape D2 is removed. Then the artificial hair fitting implement 1 is bent at the bending part 5, D1 and C1 are adhered to each other, and the artificial hair fitting implement 1*a* is fitted to the head skin 10. Then the protective tape B2 of the B side is removed, a lot of artificial hairs 11 are bundled on the surface thereof, and the bundled false hair 7*a* is adhered and fitted. Then the natural hair of an upper side is dropped down thereon and is fixed by a comb or a brush so that it looks natural.

The above example shows the false hair 7*a* adhered to the artificial hair fitting implement 1*a*; however, the artificial hair can also be planted directly on the B side of the artificial hair fitting implement 1*a*.

Moreover, since the artificial hair fitting implement 1*a* consists of an ultra-thin component of several hundreds microns like the wig fitting implement 1, it can be formed into an optional shape easily by scissors or a knife.

Hence, since the artificial hair fitting implement 1*a* can be formed into a shape according to the form or a spot with partially thin hair, it is possible to effectively increase the hair of a part in need.

In the description of the above embodiment, the artificial hair fitting implement is shown to be square in shape;

however, the shape is not restricted thereto, and it goes without saying that the artificial hair fitting implement may be formed into various shapes such as a circle, an oval, a triangle and the like according to a spot for use.

POSSIBILITY OF INDUSTRIAL UTILIZATION

The artificial hair fitting implement with the above construction of the present invention consists of an ultra-thin flexible component of only several hundreds microns, and hence, if it is put between a wig and the head skin, one has no sense of incongruity and does not feel anxious about it. Also, the appearance of the worn wig is extremely natural.

In addition, the fitting thereof is surely performed by the adhesion surfaces of two double-sided tapes, and thus, neither a feeling of oppression nor a feeling of twitching to the head is experienced during use. Also, the wig can be used for a long time and it is possible to sleep while wearing the wig.

Moreover, the fitting of the wig is sure, and even if the head is moved severely, the wig neither falls off nor slips, and thus, no uneasiness is experienced by a user during wearing of the wig, and it is unnecessary to remove the wig while practicing sports.

Hence, there is no anxiety that the wearing of the wig is known to others.

Moreover, since the artificial hair fitting implement of the present invention does not employ an adhesive on the surface coming into contact with the head skin, there is no fear of the occurrence of a rash and eczema on the head skin due to an adhesive, and there is no fear of the decrease of adhesion due to sweat and sebum oozing from the head skin.

Thus, no adhesive is employed in the present invention as a general rule. Even if an adhesive is employed in order to surely fit the natural hair pulled through the penetration holes, the amount thereof is only small and it does not adhere to the head skin and hence, the adhesive has no bad influence upon the head skin.

In addition, since this wig fitting implement has an adherent tape covered with a protective tape, adherent parts do not stick to each other when the wig is not used, and the handling thereof is easy.

When a water-resistant adhesive is employed as an adhesive to be used for double-sided tapes, it becomes possible to wash hair while wearing the wig, whereby the head is always clean, and hence, no itching results from wearing of the wig.

When the artificial hair fitting implement of the present invention is employed for false hair, it is possible to cover a part of the head skin with thin hair, and to perform the partial increase of hair easily.

The artificial hair fitting implement of the present invention consists of an ultra-thin flexible component of only several hundreds microns and can be given a proper size or form by scissors or a knife as necessary. Thus, the fitting of a wig can be performed more surely, and even if the wig is employed as a false hair fitting implement, it can effectively cover a spot with thin hair.

According to a method of the use of the artificial hair fitting implement of the present invention, the fitting implement is bent via the bending part at a center of the implement, and the insertion of the natural hair through the penetration holes and the drawing thereof can be performed easily. Thus, it is unnecessary to roll up a wig excessively while applying the wig, and slippage of the wig while wearing it can be prevented. Thus, the wearing of the wig is easy and no special skill is needed to apply the wig.

Moreover, according to the present invention, the removal of the worn wig is also easy.

That is, for the removal of the wig, the end of the wig is rolled up, the double-sided tapes adhered to each other are removed from each other, and the wig fitting implement is lifted slowly. Thus, the natural hair slips and is removed from the penetration holes, whereby the wig can be removed easily.

At this time, in the case of employing an adhesive for fitting the natural hair, the passing of the natural hair through the penetration holes can be performed more smoothly by employing a light-removing liquid to the penetration holes and the natural hair.

What is claimed is:

1. An artificial hair fitting implement comprising:

a net-like base that is bendable about a generally central portion thereof, wherein the generally central portion divides said net-like base into two sides, with each of said two sides having a front surface and a back surface;

a double-sided tape adhered to each of the front surface and back surface of each of said two sides, with said double-sided tape adhered to the back surface of each of said two sides and to the front surface of one of said two sides having a releasing paper thereon, and with said double-sided tape adhered to the front surface of the other of said two sides having a fine net-like component thereon, wherein said fine net-like component is to come into contact with the head of a wearer; and penetration holes extending through the other of said two sides for pulling hair therethrough.

2. The artificial hair fitting implement according to claim 1, wherein said penetration holes comprise holes selected from the group consisting of generally cross-shaped holes, horizontally extending slits, horizontally extending slots, vertically extending slits, vertically extending slots, and mixtures of said generally cross-shaped holes, said horizontally extending slits, said horizontally extending slots, said vertically extending slits and, said vertically extending slots.

3. A method of using an artificial hair fitting implement to fit a wig having artificial hair to the head of a wearer, comprising:

providing an artificial hair fitting implement including:

(i) a net-like base that is bendable about a generally central portion thereof, wherein the generally central portion divides said net-like base into two sides, with each of said two sides having a front surface and a back surface;

(ii) a double-sided tape adhered to each of the front surface and back surface of each of said two sides, with said double-sided tape adhered to the back surface of each of said two sides and to the front surface of one of said two sides having a releasing paper thereon, and with said double-sided tape adhered to the front surface of the other of said two sides having a fine net-like component thereon, wherein said fine net-like component is to come into contact with the head of a wearer; and (iii) penetration holes extending through the other of said two sides for pulling hair therethrough;

removing said releasing paper from said double-sided tape that is adhered to said front surface of said one of said two sides, and adhering said double-sided tape that is adhered to said front surface of said one of said two sides to a surrounding rim portion on a back side of a wig; then pulling hair of the wearer through said penetration holes from said front surface of said other of said two sides to said back surface of said other of said two sides;

removing said releasing paper from said double-sided tape that is adhered to said back surface of said one of said two sides, while adhering said double-sided tape that is adhered to said back surface of said one of said two sides to said double-sided tape that is adhered to said back surface of said other of said two sides after removing said releasing paper from said back surface of said other of said two sides.

4. A method of using an artificial hair fitting implement to fit a wig having artificial hair to the head of a wearer, comprising:

providing an artificial hair fitting implement including:

(i) a net-like base that is divided into two sides, with each of said two sides having a front surface and a back surface; and (ii) a double-sided tape adhered to each of the front surface and back surface of each of said two sides, with said double-sided tape adhered to the back surface of each of said two sides and to the front surface of each of said two sides having a protective tape adhered thereto;

removing said protective tape from said double-sided tape that is adhered to said front surface of one of said two sides, and adhering said double-sided tape that is adhered to said front surface of said one of said two sides to a surrounding rim portion of a wig, while arranging the other of said two sides at an inner side of the wig; then rolling up said surrounding rim portion, while bending said artificial hair fitting implement at a position between said two sides such that said front surface of said other of said two sides is positioned at the head of the wearer;

removing said protective tape from said double-sided tape that is adhered to said back surface of said other of said two sides, and pulling hair of the wearer from said front surface of said other of said two sides to said back surface of said other of said two sides through penetration holes provided in said other of said two sides;

pressing said back surface of said other of said two sides such said protective tape that is adhered to said front surface of said other of said two sides comes into contact with the head of the wearer, while the hair of the wearer that has been pulled through the penetration holes is pulled lightly so that said back surface of said other of said two sides is pressed near roots of the hair that has been pulled through the penetration holes; and removing said protective tape from said double-sided tape that is adhered to said back surface of said one of said two sides, and holding the hair that has been pulled through the penetration holes between said double-sided tape that is adhered to said back surface of said one of said two sides and said double-sided tape that is adhered to said back surface of said other of said two sides.

5. An artificial hair fitting implement comprising:

a net-like base that is bendable about a generally central portion thereof, wherein the generally central portion divides said net-like base into two sides, with each of said two sides having a front surface and a back surface;

artificial hair extending from the front surface of one of said two sides;

a double-sided tape adhered to the back surface of said one of said two sides and to the back surface and front surface of the other of said two sides, with said double-sided tape adhered to the back surface of each of said two sides having a releasing paper thereon, and with said double-sided tape adhered to the front surface of the other of said two sides having a fine net-like component thereon, wherein said fine net-like component is to come into contact with the head of a wearer; and penetration holes extending through said other of said two sides for pulling hair therethrough.

* * * * *